United States Patent [19]

Martin

[11] 4,335,379

[45] Jun. 15, 1982

[54] METHOD AND SYSTEM FOR PROVIDING AN AUDIBLE ALARM RESPONSIVE TO SENSED CONDITIONS

[76] Inventor: John R. Martin, 2345 W. Mill Rd., Milwaukee, Wis. 53209

[21] Appl. No.: 75,218

[22] Filed: Sep. 13, 1979

[51] Int. Cl.[3] ..... G08B 17/10

[52] U.S. Cl. ..... 340/634; 179/1 SM; 340/692; 340/628

[58] Field of Search ..... 340/632, 633, 634, 628, 340/506, 692; 360/12; 179/1 SG, 1 SM; 422/94, 95, 96, 97; 73/23

[56] References Cited

U.S. PATENT DOCUMENTS

| | | | |
|---|---|---|---|
| 3,733,595 | 5/1973 | Benedict | 340/634 X |
| 3,755,794 | 8/1973 | Stapleford | 179/1 SM |
| 3,801,972 | 4/1974 | Hokim et al. | 340/628 X |
| 3,870,818 | 3/1975 | Barton et al. | 340/692 X |
| 3,895,367 | 7/1975 | Visser | 340/634 |
| 3,950,739 | 4/1976 | Campman | 340/634 X |
| 4,007,456 | 2/1977 | Paige et al. | 340/634 |
| 4,072,986 | 2/1978 | Heidergren | 360/12 |
| 4,117,263 | 9/1978 | Yeh | 179/1 SM |
| 4,163,120 | 7/1979 | Baumwolspiner | 179/1 SM |

OTHER PUBLICATIONS

Figaro Gas Sensor TGS #109; 9-20-76, 8 page brochure of Figaro Engineering, Inc.

Figaro TGS Gas Sensor-General Catalogue, 9-20-76; 12 page brochure, Figaro Engineering, Inc.

Figaro Gas Sensor TGS #812; 9-20-76; 5 page brochure of Figaro Engineering, Inc.

*Primary Examiner*—John W. Caldwell, Sr.

*Assistant Examiner*—Daniel Myer

*Attorney, Agent, or Firm*—Burns, Doane, Swecker & Mathis

[57] ABSTRACT

An alarm system responsive to a predetermined concentration of gaseous hydrocarbon in an area. A gaseous hydrocarbon responsive variable resistance element having a heater has resistance characteristics that are relatively stable upon energization of the heater beyond an initial heating period, decrease from the relatively stable value as a function of the concentration of gaseous hydrocarbons in the vicinity of the sensor, and decrease to an initial action resistance value substantially below the stable value during the initial heating period. First and second switching devices connected in series with a power source produce an audible alarm signal with both in their conductive condition. A first trigger circuit triggers the first switching device into its conductive condition in response to the variable resistance element decreasing from the relatively stable value at least to a predetermined resistance value above the initial action resistance value to indicate a predetermined concentration of gaseous hydrocarbons in the vicinity of the resistance element. A second trigger circuit includes a capacitor connected to be charged to at least a predetermined charge level upon energization of the heater and triggers the second switching device into its conductive condition in response to the capacitor achieving the predetermined charge level. A third trigger circuit is connected to the first switching device to intermittently trigger the first switching device into its conductive condition in response to the occurrence of an abnormal condition of the sensor. The alarm circuit can synthesize and annunciate a predetermined spoken message in response to a sensed alarm condition.

5 Claims, 6 Drawing Figures

METHOD AND SYSTEM FOR PROVIDING AN AUDIBLE ALARM RESPONSIVE TO SENSED CONDITIONS

BACKGROUND OF THE INVENTION

The present invention relates to alarm systems and, more particularly, to a method and system for providing an audible alarm to alert occupants of a building and/or authorities to the presence of an abnormal condition such as an excess concentration of potentially combustible gaseous hydrocarbons within a building or area.

It has become desirable and, in many instances, even mandatory to provide alarm systems that sense abnormal or undesirable conditions and alert the occupants of a building to the presence of the abnormal condition so that appropriate action may be taken. Numerous types of smoke and fire detectors, gas detectors, intrusion detectors and other such alarm systems are currently in use for such purposes. In a typical residence, for example, three or four such systems for detecting different conditions may be in use.

The typical alarm system utilizes a sensor to sense a condition such as smoke or gas concentration and an audible alarm such as a buzzer, horn or siren to provide an alerting sound when the sensed condition is abnormal. The type of sensor employed will, of course, depend upon the condition being sensed. For smoke alarm systems, various types of photoelectric and ionization type sensors are employed to determine when the concentration of smoke in the air exceeds some predetermined value. Intrusion detectors utilize a large number of different types of sensors while typical gas alarms, usually for indicating the presence of gaseous hydrocarbons, employ a sensor which is basically a bulk semiconductor material composed mainly of tin dioxide which, when heated, exhibits a resistance drop related to the concentration of gaseous hydrocarbons in the vicinity of the sensor.

One aspect of this invention relates broadly to various alarm systems. Within a single residence or other occupied space, there may be several alarms for different conditions. For example, there may be a burglar alarm to detect intrusion, a smoke alarm to detect combustion and a gas alarm to detect gas leaks. The usual alarm system provides an audible alarm through the energization of a transducer such as a piezoelectric or electromagnetic "buzzer". While there may be some difference between the sounds produced by the various alarms, they are heard very infrequently and it may be difficult to readily ascertain which alarm is sounding when the alarm condition is detected. It is, of course, extremely important to take relatively fast action when one of the alarms sounds so any delay in ascertaining which alarm has been triggered could be extremely dangerous or even fatal.

It is accordingly one object of the present invention to provide a novel method and system for providing an alarm signal which permits the immediate recognition of the sensed alarm condition through the provision of a spoken message.

Another more specific aspect of the present invention relates to alarm systems for detecting the occurrence of a predetermined concentration of gaseous hydrocarbons in an occupied area and providing an alarm. The usual gas detection system employs a sensor that is composed mainly of tin dioxide and exhibits certain variable resistance characteristics when heated and exposed to gaseous hydrocarbons. Typical of such gas sensors are the TGS 109, TGS 812 and TGS 813 gas sensors available from Figaro Engineering, Inc., of Japan. The Figaro gas sensors have a variable resistance element and a heater connected to electrodes in such a manner that the variable resistance element (the bulk semi-conductor tin dioxide) is heated when the sensor is energized. The resistance between two of the electrodes connected to the resistance element varies in accordance with known characteristics and can be sensed as an indication of gaseous hydrocarbon concentration.

Specifically, the resistance characteristics of this type of gas sensor are such that the resistance value is very high when the semi-conductor material is unheated and is also at a relatively high, stable resistance value after the semi-conductor has been heated for a predetermined time period, usually from 1 to 3 minutes. The resistance value remains at this relatively stable value as long as the heater is energized (barring failure) and decreases from the relatively stable value as a function of the concentration of gaseous hydrocarbons in the vicinity of the resistance element. However, upon initial energization of the heating element, there is a substantial decrease in the resistance value between the time of initial energization of the heating element and the end of the initial 1 to 3 minute heating interval.

In known gas alarms, the value of the resistance element is sensed in order to provide an alarm when the concentration of gaseous hydrocarbons exceeds some predetermined value, usually about 10% of the lower explosive level of the most common gas expected to be encountered. It will be appreciated that if the resistance of the sensor is directly sensed to provide an alarm, an alarm will occur sometime within the first second of initial turn-on as well as when the undesirable level of gas concentration is reached since the resistance at the undesirable gas concentration level is higher than the low value reached during initial turn-on. This is undesirable and, in fact, is not permitted in accordance with U. L. specifications.

Various circuits have been devised to prevent an alarm condition from occurring except after the resistance element has been heated and has reached its relatively stable value. These circuits are extremely complex and therefore are costly and more likely to fail in normal use. Moreover, when fault circuitry is added to detect common malfunctions of such alarm systems, they become even more complex, costly and prone to failure.

It is accordingly another object of this invention to provide a method and circuit for producing a first audible alarm only when the concentration of gaseous hydrocarbon in a protected area reaches a predetermined level and a second audible alarm upon occurrence of common malfunctions in the circuit, wherein complexity is minimized resulting in decreased cost and size, and increased reliability.

BRIEF SUMMARY OF THE INVENTION

In accordance with one aspect of the present invention, there is provided a relatively simple, economical and reliable alarm system for providing an alarm upon the occurrence of a predetermined concentration of gasesous hydrocarbon in an area. The alarm system employs a conventional sensor including a gaseous hydrocarbon responsive variable resistance element connected between two electrodes and a heating element for heating the variable resistance element. The resistance between the electrodes is related in value to the resistance of the variable resistance element, which resistance assumes a predetermined, relatively stable resistance value upon energization of the heating means beyond an initial heating (initial action) period. The resistance value of the resistance element decreases from the relatively stable value as a function of the concentration of gaseous hydrocarbons in the vicinity of the sensor and also exhibits a decrease in resistance to an initial action resistance value substantially below the stable value during the initial heating period. A series circuit arrangement comprising first and second switching means each operable between conductive and non-conductive conditions in response to a trigger signal is connected in series with a power source. The switching means produce an alarm signal with both the first and second switching means in the conductive condition and an alarm means is provided to sound an audible alarm in response to the alarm signal. An alarm trigger circuit triggers the first switching means into its conductive condition in response to the variable resistance element decreasing at least to a predetermined resistance value, which resistance value is below the stable value by an amount signifying a predetermined concentration of gaseous hydrocarbons in the vicinity of said resistance element. The predetermined resistance value is above the initial action resistance value occurring during the initial heating period. A delay trigger circuit, including a capacitor having a charging path which includes the first switching means, is connected to be charged to at least a predetermined charge level, upon energization of the heating element. The delay trigger circuit triggers the second switching means into its conductive condition in response to the capacitor achieving the predetermined charge level.

A fault trigger circuit means is connected to the first switching circuit means and intermittently triggers the first switching circuit means into its conductive condition in response to the occurrence of an abnormal condition of the sensor.

In accordance with another aspect of the invention there is provided an alarm system comprising a sensing means for sensing a predetermined alarm condition and generating an alarm signal in response to the sensed condition. An audible alarm means synthesizes and annunciates a predetermined spoken message related to the sensed alarm condition in response to the alarm signal from the sensing means. In one embodiment of the alarm system, the sensing means comprises a gas sensor for sensing the presence of gaseous hydrocarbons in excess of a predetermined concentration. The sensed alarm condition is a concentration of gaseous hydrocarbons above the predetermined concentration and the annunciated message contains the spoken word "gas".

The various features and aspects of the invention with their attendant advantages will be more fully understood with reference to the following detailed description when read in conjunction with the appended drawings.

DETAILED DESCRIPTION

Certain aspects of the present invention are broadly applicable to alarm systems in general but for convenience will be described hereinafter in connection with a specific gas alarm embodiment. The broader applicability of such inventive features will be appreciated by those skilled in the art to which the invention pertains and the coverage of such features is not intended to be limited to the gas alarm environment. Specifically, the spoken word synthesizer and annunciator described hereinafter in greater detail may be used with a variety of alarm systems to ensure immediate recognition of the alarm condition which has been sensed.

Figure 1:
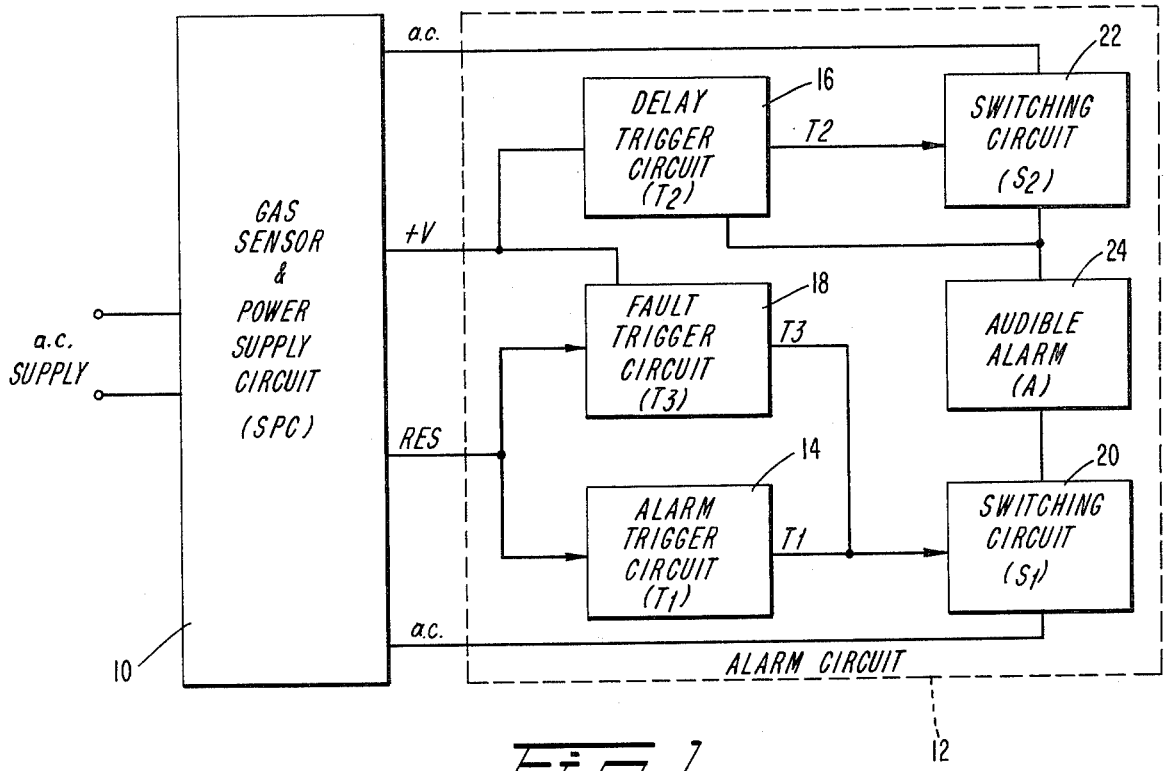
FIG. 1 is a functional block diagram of a gas alarm system in accordance with one aspect of the present invention.

Referring now to FIG. 1, a gas sensor and power supply circuit 10 receives power from an a.c. source (e.g., 110 volts 50 or 60 cycle a.c.) and provides power signals (a.c. and +V) and sensor signals RES to an alarm circuit 12. The alarm circuit 12 includes an alarm trigger circuit 14, a delay trigger circuit 16 and a fault trigger circuit 18. Also, included in the alarm circuit are two switching circuits 20 and 22 and an audible alarm 24.

The switching circuits 22 and 20 are connected in a series circuit arrangement across an a.c. power source supplied from the circuit 10. As will be described hereinafter in detail, the switching circuits may be triggered from a non-conductive condition to a conductive condition and, when both switching circuits are conducting, an alarm signal is produced between the circuits 20 and 22. This alarm signal, when produced, is used to sound the audible alarm 24 as will be subsequently described.

The alarm trigger circuit 14 receives the sensor signal RES from the circuit 10. The sensor signal RES is indicative of the resistance value of the gas sensor in the circuit 10, which resistance value is related to the concentration of gaseous hydrocarbons in the vicinity of the sensor. A trigger signal T1 is produced by the trigger circuit 14 in response to a resistance value below a predetermined level representative of a predetermined level of gaseous hydrocarbons. The trigger signal T1 is applied to the trigger input terminal of the switching circuit 20 and this triggers the switching circuit 20 into its conductive state when the sensor signal RES indicates a resistance value below the predetermined level.

As was previously mentioned, the gas sensor resistance characteristic is such that during an initial action or initial heating period of the sensor immediately subsequent to turn-on, the gas sensor resistance drops drastically and then returns to a relatively stable value. This drop in resistance will be below the level required to enable the alarm trigger circuit 14 so the trigger signal T1 will be produced and the switching circuit 20 (S1)

will be triggered to its conductive state. During the initial action period, however, the switching circuit 22 will be non-conductive and an alarm signal will not be produced.

More specifically, the delay trigger circuit 16 is essentially a timing circuit which produces a trigger signal T2 only after the gas sensor and power supply circuit has been energized for a predetermined time period. This delay time is selected such that the delay trigger circuit 16 produces the trigger signal T2 at a time equal or subsequent to the end of the initial action period. Accordingly, the delay trigger signal T2 is produced, and triggers the switching circuit 22 (S2) into conduction after the gas sensor has been energized and has reached its relatively stable resistance value. At that time, the switching circuit 20 is non-conductive, assuming there is no excessive concentration of gaseous hydrocarbons in the vicinity of the sensor. Therefore, the alarm 24 does not sound during the initial action period. Since the switching circuit 22 is held in its conductive state by the delay trigger circuit at the end of the delay period, any subsequent generation of the alarm trigger T1 will trigger the switching circuit 20 into conduction and cause the sounding of a gas alarm.

The fault trigger circuit receives the power supply voltage +V and also receives the sensor signal RES and monitors this signal. One common fault which occurs in gas alarm systems is that the gas sensor becomes open-circuited. The fault trigger circuit monitors this condition as well as other abnormal open circuit conditions and produces the trigger signal 13 when such a condition occurs. As will be seen hereinafter, the trigger signal T3 is a periodic (pulsed) signal and therefore periodically triggers the switching circuit 20 into its conductive state in response to a sensed abnormality. The alarm 24 thus produces a fault signal different from an alarm signal when a fault is sensed.

Figure 2:
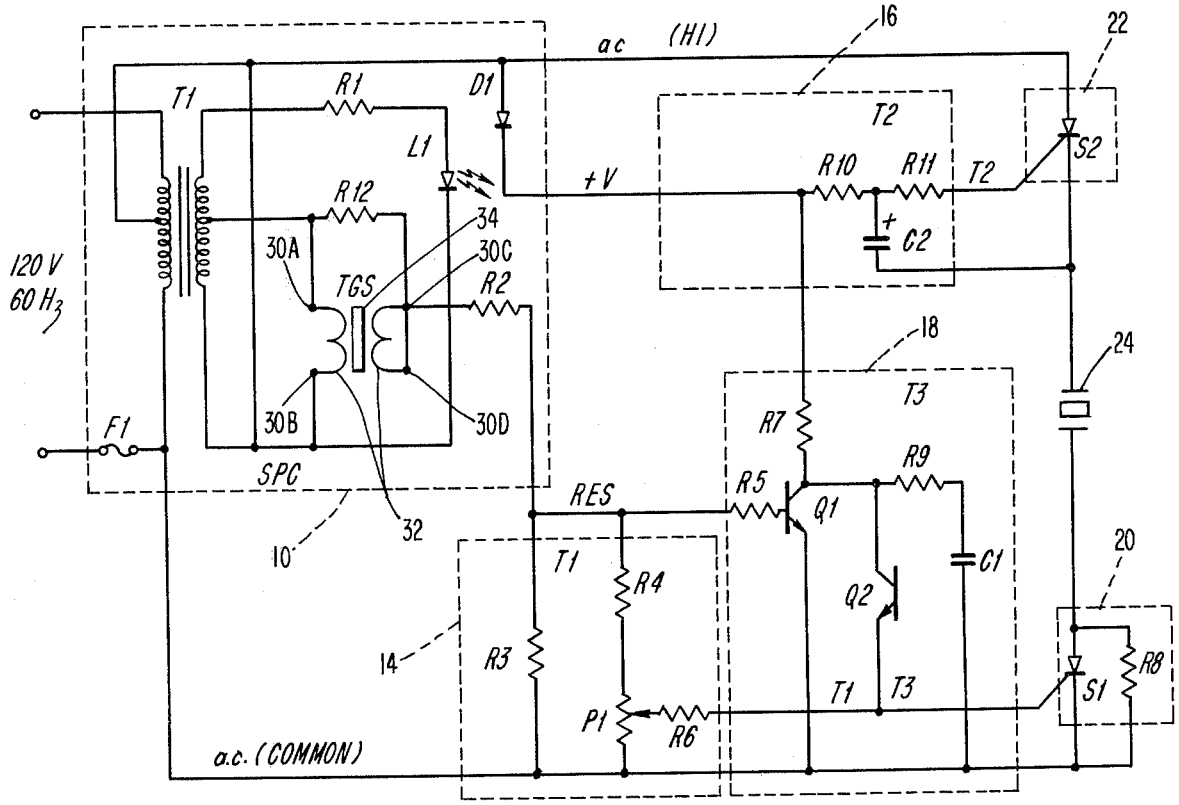
FIG. 2 is a detailed schematic diagram of one embodiment of the alarm system of FIG. 1.

FIG. 2 illustrates one embodiment of the gas alarm system of FIG. 1 in greater detail. Referring now to FIG. 2, a suitable a.c. power source is connected to a transformer T1 through a fuse F1. A suitable value of a.c. voltage (e.g., 100 volts) is supplied from the primary winding of the transformer via terminals designated a.c. (HI) and a.c. (common) to conventional SCR switches S1 and S2 which are connected in a series circuit arrangement between the a.c. voltage terminals.

Figure 3:
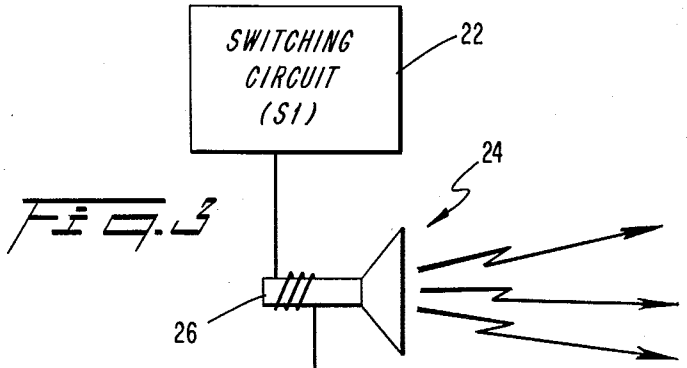
FIG. 3 is a schematic diagram illustrating one embodiment of the audible alarm of FIGS. 1 and 2 in greater detail.

A conventional piezoelectric or electromagnetic transducer providing a suitable audible alarm 24 is connected in series between the SCR's 20 and 22 to provide an audible alerting signal when the SCR's are both triggered into conduction. For example, as is illustrated in FIG. 3, the coil of a suitable electromagnetic transducer 26 may be connected in series with the SCR switches 20 and 22 so that current flowing through the switches when both are conducting will be sufficient to drive the transducer and produce an alarm sound.

With continued reference to FIG. 2, the secondary of the transformer T1 produces a voltage suitable to energize the heater of a conventional gas sensor TGS. With a Figaro model TGS 109 the necessary heater voltage is about 1.0 volts a.c., and thus the secondary voltage applied to the heater of the gas sensor from a center tap on the secondary winding is preferably of this value. The voltage across the entire secondary winding with this illustrated arrangement is on the order of 2.0 volts a.c., and is connected across a series limiting resistor R1 and a light emitting diode L1 to provide a "power on" indication.

In the embodiment illustrated in FIG. 2, the gas sensor is a TGS 109 sensor available from Figaro Engineering, Inc. The gas sensor includes electrodes 30A–30D, a heating element 32 and a bulk semi-conductor resistance element 34 composed mainly of tin dioxide. The heater voltage of about 1.0 volts a.c. is connected to the electrodes 30A and 30B. The 100 volt a.c. lone voltage a.c. (HI) is connected to terminal 30B and terminals 30C and 30D are connected together and through resistors R2 and R3 to the a.c. (common) terminal. Thus the heater 32 is energized by 1.0 volts and there is a 100 volt potential across the series combination of the resistance element 34 and the resistors R2 and R3. A limiting resistor R12 is connected across the resistance element 34 between terminals 30A and 30C of the sensor.

The resistors R2-R3 junction is connected through a resistor R4 and a potentiometer P1, in series, to the a.c. (common) terminal and through a resistor R5 to the base electrode of a conventional NPN transistor Q1. The collector electrode of transistor Q1 is connected through a resistor R7 and a diode D1 to the transformer terminal a.c. (HI). The emitter electrode of the transistor Q1 is connected to the a.c. (common) terminal.

The arm of the potentiometer P1 is connected through a current limiting resistor R6 to the trigger electrode of the SCR switch 20 and to the cathode or emitter electrode of a conventional voltage sensitive trigger device Q2 (e.g., a trigger transistor or neon bulb). The anode or collector electrode of the trigger device Q2 is connected to the collector electrode of the transistor Q1 and through a series RC network comprising a resistor R9 and a capacitor C1.

The junction of the cathode of the diode D1 and the resistor R7 is connected through series resistors R10 and R11 to the trigger input terminal of the SCR switch 22. The resistor R10-R11 junction is connected through a capacitor C2 to the junction of the SCR switch 22 cathode and the alarm 24. A resistor R8 is connected in parallel with the SCR switch 20 so that a charging path for the capacitor C2 is established through the SCR switch 20 (when conducting) or the resistor R8, the resistor R10 and the diode D1.

Figure 6A:
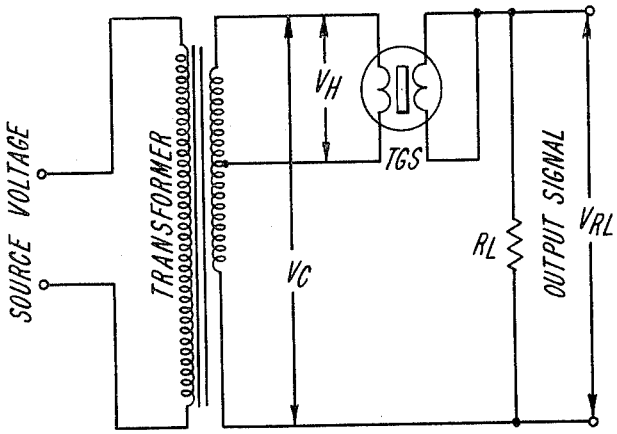
FIGS. 6B and 6C are graphs illustrating the resistance characteristics of a TGS 109 gas sensor as measured in terms of the signal drop across a load in a measuring circuit such as is illustrated in FIG. 6A.
Figure 6B:
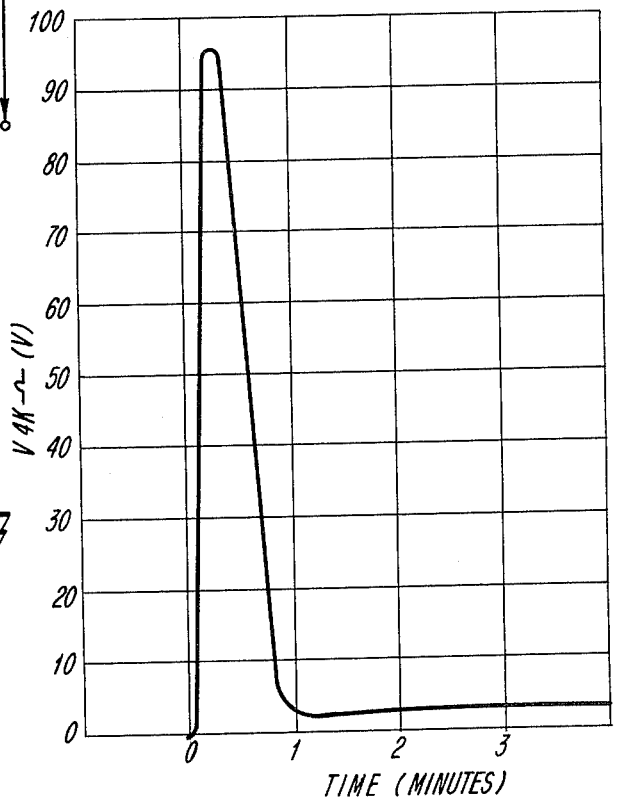
Figure 6C:
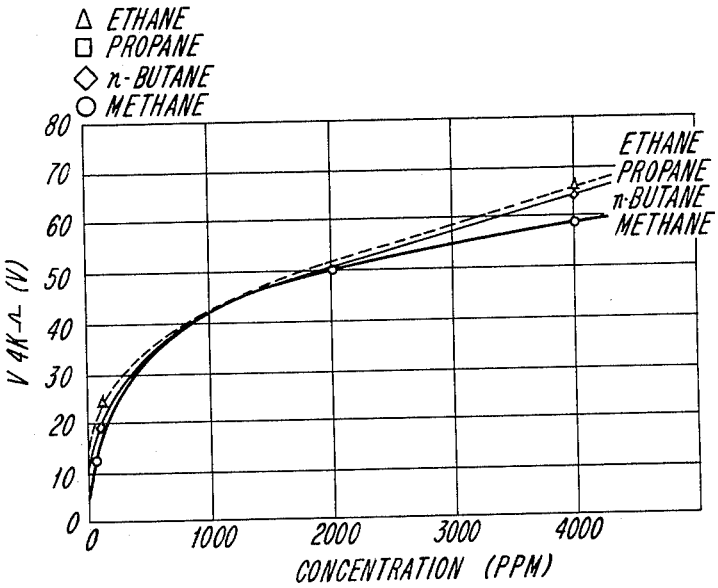

To facilitate an understanding of the operation of the FIG. 2 embodiment of the present invention, reference may be had to FIGS. 6A–6C. The gas sensor TGS of FIG. 2 has resistance characteristics approximately as illustrated in FIGS. 6B and 6C when measured (in terms of conductance—the output signal across a load) with the circuit of FIG. 6A. Using the circuit of FIG. 6A, with a heater voltage VH of 1.0 volts and a circuit voltage VC of 100 volts, an output signal VRL across a 4 Kohm resistor RL indicative of variations in resistance of the gas sensor resistance element can be measured.

FIG. 6B shows the initial heating or initial action period of the gas sensor wherein the heater is initially energized at time 0. The graph of FIG. 6B illustrates, for example, that the gas sensor resistance element is essentially an open circuit value (i.e., zero conductivity and thus zero volt output signal) before the heater is energized. At time 0 when the heater is energized, the resistance almost immediately decreases (i.e., conductivity and thus output voltage increases) dramatically to an initial action value. After the initial action or initial heating period which is approximately one minute with the TGS 109 sensor, the resistance value of the resistance element increases and assumes a relatively stable, high value (i.e., the conductivity drops and the output signal assumes a low value of about 2 to 3 volts).

FIG. 6C illustrates the resistance of the gas sensor resistance element when operating in the relatively stable region after initial heating (i.e., after about 1 minute and preferably after about 3 minutes) and when various types of lower gaseous hydrocarbons are introduced in various concentrations in the vicinity of the sensor. It can be seen from FIG. 6C that when concentrations of from 0 to 4000 parts per million (ppm) of various lower hydrocarbon gases are introduced, the resistance of the gas sensor resistance element decreases (the output signal increases) as a function of the concentration of the gas in the vicinity of the sensor.

Ordinary household gas primarily contains the low hydrocarbons and thus these gases (e.g., methane, propane, butane and ethane) are of primary interest in a residential or office building setting. In this regard, the alarm circuit is preferably set so as to provide an audible signal when the concentration of such gases in the vicinity of the sensor reaches a level of about 10% of the lower explosive limit (e.g., about 2000 ppm). It will be appreciated, however, that other hydrocarbons in gaseous states also cause the sensor to exhibit similar resistance changes in their presence. Thus, for example, the resistance of the gas sensor resistance element will vary inversely with the concentration of hydrogen, ammonia and carbon monoxide as well as the fumes of common organic solvents such as ethanol, acetone, n-hexane and benzene.

With reference once again to FIG. 2, the operation of the gas alarm is as follows. Power is initially supplied to the transformer T1, energizing the gas sensor TGS and the alarm circuit. When the heater 32 is initially energized, there is a substantial decrease in the resistance value of the resistance element 34 and the voltage at the arm of potentiometer P1 increases in a manner similar to that illustrated in FIG. 6B. Accordingly, during the initial heating interval (i.e., for about the first minute of energization), the SCR switch 20 is triggered into conduction by the trigger circuit 14.

Simultaneously, the SCR switch 22 is in a non-conductive condition since the capacitor C2 is uncharged and the voltage from the trigger circuit 16 is initially zero. Current flows through the resistor R8 (and the switch S1 when conducting), through the alarm 24, through the capacitor C2, through the resistor R10 and through the diode D1. These elements form an RC timing circuit, and the capacitor C2 charges through the above charging path to a level sufficient to trigger the SCR switch 22 into conduction over a period of time in excess of the initial action or heating period of the gas sensor. In the illustrated embodiment, the capacitor C2 and the components in the charging path are selected such that the capacitor C2 charges to the appropriate trigger level after about 2 to 3 minutes, well beyond the end of the initial action period.

When the initial action period ends, the resistance of the resistance element 34 assumes a relatively stable value sufficiently high to lower the voltage of the trigger signal T1 to a level insufficient to trigger the SCR switch 20. The SCR switch 20 becomes non-conductive and the capacitor C2 continues to charge through the resistor R8. Shortly thereafter, the capacitor C2 reaches a level of charge sufficient to trigger the SCR switch 22 into conduction, in which state it remains while the alarm circuit is energized.

It will thus be appreciated that the SCR switches 20 and 22 are alternately conductive during the initial action period but do not conduct simultaneously. The charging current of capacitor C2 passing through the alarm 24 is insufficient to sound the alarm and thus no audible signal occurs during the initial action period despite the substantial drop in the resistance of the resistance element 34 during this period. However, after the capacitor C2 is charged and the SCR switch 22 is conductive, any triggering of the SCR switch 20 will sound the alarm.

With the above conditions established (i.e., after about three minutes from energization), gaseous hydrocarbons in the vicinity of the sensor TGS will cause a decrease in sensor resistance and an increase in the voltage level of the trigger signal T1. The potentiometer P1 is preferably adjusted so that when the concentration of the most common household gaseous hydrocarbons (the lower hydrocarbons C1 to C4) in the vicinity of the sensor is about 2000 ppm (10% of the lower explosive limit), the trigger signal T1 is of a sufficient voltage to trigger the SCR switch 20 into conduction. Accordingly, in the presence of gaseous hydrocarbons of a predetermined concentration or greater, the SCR switch 20 will be triggered and, since the SCR switch 22 is already conductive, an alarm signal will be produced at the junction of the switches 20 and 22 and an alarm will be sounded. This alarm will be a steady tone in the illustrated embodiment and will continue until the gas concentration decreases below the predetermined value.

Since one of the most common failures of the type of gas sensor illustrated is for the sensor resistance element to be open-circuited, the trigger circuit 18 (T3) is provided to detect such a condition and sound a failure alarm. When the gas alarm circuit is energized, the transistor Q1 is turned on as long as there is a certain detectable current flow through the gas sensor resistance element. These resistance elements may vary widely in resistance and some, even though they are good, may be quite high. A limiting resistor R12 is thus provided in parallel with the sensor so that the parallel combination of sensor resistance element 34 and resistor R12 will provide the necessary current flow to maintain the transistor Q1 in conduction as long as the circuit is energized and the gas sensor resistance element is not open-circuited.

With the transistor Q1 on, the capacitor C1 remains discharged and the trigger device Q2 remains non-conductive. However, if the gas sensor resistance element opens or if some other open circuit fault occurs in the sensing circuit and the RES signal drops below the level required to hold the transistor Q1 on, then the transistor Q1 is cut off and the voltage across resistor R9 and capacitor C1 is allowed to increase toward the voltage +V. The capacitor C1 thus charges and, when the trigger level of the trigger device Q2 is reached, the capacitor C1 discharges through the device Q2, producing the trigger signal T3 and triggering the SCR switch 20 into conduction. Conduction of the SCR switch 20 causes the production of an alarm signal, sounding the alarm 24.

Eventually, the capacitor C1 discharges sufficiently to allow the trigger device Q2 to turn off. In this regard, it should be noted that the trigger device is a conventional device such as a semi-conductor trigger or neon bulb that has a trigger level higher than its sustaining level. The trigger signal T3 is thus removed and the alarm turns off. Of course, when the device Q2 becomes non-conductive, the capacitor C1 again charges and, after a predetermined time, again triggers the trigger device Q2 and sounds the alarm. Thus, a periodic or intermittent audible alarm, different from the steady gas alarm sound, is produced when a fault is detected.

Typical circuit values to achieve operation of the gas alarm as described above with a Figaro TGS 109 gas sensor may be as listed below:

D1 Diode, 1N4004 or equiv.
C1 Capacitor, 2 mfd. Aluminum Electrolytic, 50 volt
c2 Capacitor, 1000 mfd. Aluminum Electrolytic, 6.3 volt
H1 Horn, Kobishi Type CLB 26 or Edwards Type 123-N5, 120 VAC
L1 LED, red
P1 Potentiometer, 500 ohms.
Q1 Transistor, 2N2925 or equiv.
Q2 Trigger, 1N5160 Motorola
Q3 SCR, 2N5064 Motorola
Q4 SCR, 2N5064 Motorola
R1 Resistor, 47 ohms, ¼ watt
R2 Resistor, 3.3 Kohms, 2 watt
R3 Resistor, 920 ohms, ½ watt
R4 Resistor, 3.9 Kohms, ¼ watt
R5 Resistor, 22 Kohms, ¼ watt
R6 Resistor, 4.7 Kohms, ¼ watt
R7 Resistor, 1 Meg ohms, ¼ watt
R8 Resistor, 100 Kohms, ¼ watt
R9 Resistor, 10 Kohms, ¼ watt
R10 Resistor, 10 Meg ohms, ¼ watt
R11 Resistor, 100 Kohms, ¼ watt
R12 Resistor, 220 Kohms, ½ watt
T1 Transformer, to desired specifications As was previously mentioned, the alarm 24 may be a suitable piezoelectric or electromagnetic transducer such as that illustrated in FIG. 3. With such a transducer, the alarm signal, in the form of current above a predetermined level flowing when both switches are conductive, may be supplied directly to the transducer through a coil, as illustrated or through the piezoelectric element. Alternatively, an alarm signal may be developed across a suitable load and supplied to an audible alarm device (not shown).

According to another aspect of the present invention, the audible alarm may be provided in the form of a spoken message. Since several alarm systems for different conditions may be located within a building, the spoken message will assist in an immediate determination of which alarm has been triggered.

Figure 4:
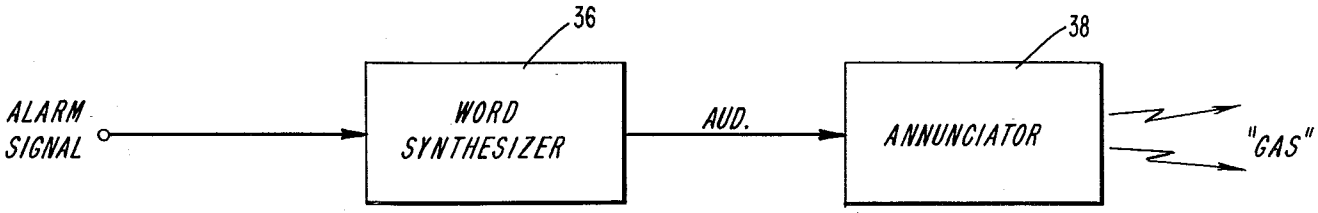
FIG. 4 is a functional block diagram illustrating an audible alarm according to another aspect of the present invention wherein a spoken message is produced in response to an alarm signal.
Figure 5:
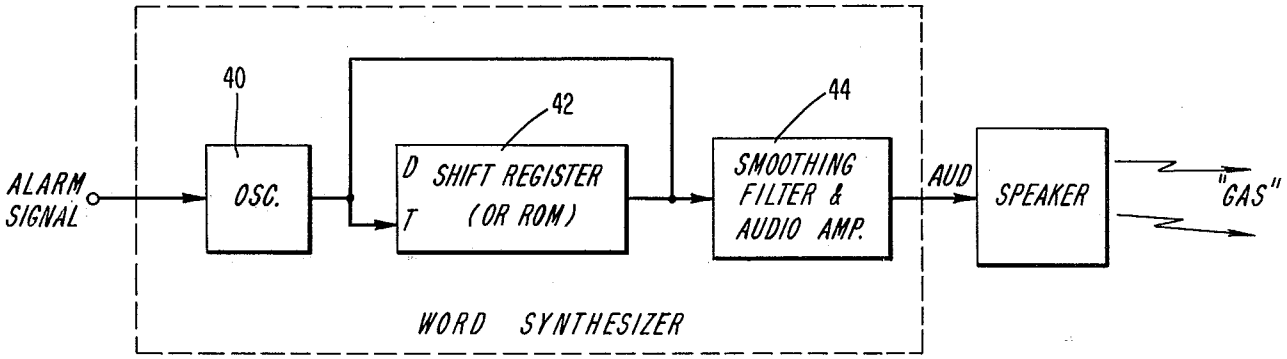
FIG. 5 is a functional block diagram illustrating the audible alarm of FIG. 4 in greater detail.

One embodiment of a circuit for providing such a system is illustrated in FIGS. 4 and 5. As is shown in FIG. 4, the alarm signal produced by an alarm circuit such as a gas alarm circuit may be applied to a word synthesizer 36 which, when triggered, provides an audio signal AUD representing a spoken message. The audio signal AUD may be applied to a suitable annunciator 38 for conversion to an audible message.

The word synthesizer 36 is preferably a digital device including a memory for storing an encoded spoken message. As is illustrated in FIG. 5, for example, the alarm signal may be a d.c. level which, when high on binary ONE, enables an oscillator 40. The oscillator 40 clocks a suitable memory such as a circulating shift register 42 in order to clock the digitally encoded message to a speaker 46 or other suitable annunciator by way of a smoothing filter 44, if required by the annunciator to smooth the digital signal from the memory.

It will be appreciated that a spoken message such as the word "gas" can be stored in a register or other memory as a series of pulses of various spacing, width or, in sample and hold type memories, various amplitudes. These pulses, when read out of the memory in a prearranged sequence, produce an average d.c. level that electrically represents the modulation involved in the production of a spoken message such as the word "gas". Accordingly, when the pulses are applied to a suitable annunciator (after filtering to produce an average d.c. level, if required), a desired spoken message is produced.

The memory will, of course, vary in capacity depending upon the length and complexity of the spoken message and the type of encoding employed. Moreover, it will be appreciated that various types of commercially available memories or even commercially available word synthesizers may be utilized. Thus, for example, the oscillator 40 or other suitable timing device may clock an address generator which, in turn, may address a read only memory (ROM) in a predetermined sequence. Moreover, various sequences or plural synthesizers may be used to provide various messages in each alarm device. Thus, a gas alarm may produce the messages "gas", "fault" and "replace battery" (if it is a battery operated device). A smoke detector may have one or more synthesizers to produce the messages "fire" (or "smoke"), "fault" and "replace battery". An intrusion alarm may have synthesizers to produce messages such as "intruder-rear door", "intruder-front door", "intruder-rear window", etc., depending upon which alarm sensor is triggered.

The present invention may be embodied in other specific forms without departing from the spirit or essential characteristics thereof. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. An alarm system for providing an alarm upon the occurrence of a predetermined concentration of gaseous hydrocarbon in an area comprising:

a sensor including a gaseous hydrocarbon responsive variable resistance element connected between two electrodes and means for heating said variable resistance element, the resistance between said electrodes being related in value to the resistance of said variable resistance element, the resistance of said variable resistance element assuming a predetermined, relatively stable resistance value upon energization of said heating means beyond an initial heating period, and said resistance value decreasing from said relatively stable value as a function of the concentration of gaseous hydrocarbons in the vicinity of said sensor, and a decrease in said resistance value to an initial action resistance value substantially below said stable value during the initial heating period;

a series circuit arrangement comprising first and second switching means connected in series with a power source, each of said switching means being operable between conductive and non-conductive conditions in response to a trigger signal, said switching means producing an alarm signal with both the first and second switching means in the conductive condition;

alarm means for sounding an audible alarm in response to said alarm signal;

first trigger circuit means for triggering said first switching means into its conductive condition in response to said variable resistance element decreasing at least to a predetermined resistance value, which resistance value is below said stable value by an amount signifying a predetermined concentration of gaseous hydrocarbons in the vicinity of said resistance element, said predetermined resistance value being above said initial action resistance value occurring during said initial heating period;

second trigger circuit means including a capacitor having a charging path which includes said first switching means and connected to be charged to at least a predetermined charge level upon energization of said heating means, said second trigger circuit means triggering said second switching means into its conductive condition in response to said capacitor achieving said predetermined charge level; and third trigger circuit means connected to said first switching circuit means for intermittently triggering said first switching circuit means into its conductive condition in response to the occurrence of an abnormal condition of said sensor.

2. The alarm system of claim 1 wherein said alarm means is connected in series between said first and second switching means and comprises a current responsive audible alarm for generating an audible tone in response to current flow therethrough above a predetermined value.

3. The alarm system of claim 2 wherein said current responsive audible alarm is a piezoelectric transducer.

4. The alarm system of claim 1 including a limiting resistor connected in parallel with said sensor between said first and second electrodes to maintain said stable value of resistance of said resistance element at a value below an apparent open circuit value.

5. The alarm system of claim 1 wherein said alarm means is connected to receive said alarm signal produced between said first and second switching means and comprises means for synthesizing and annunciating a predetermined spoken message related to a sensed alarm condition.

* * * * *